United States Patent [19]

Bornhorst

[11] Patent Number: 4,602,321

[45] Date of Patent: Jul. 22, 1986

[54] LIGHT SOURCE HAVING AUTOMATICALLY VARIABLE HUE, SATURATION AND BEAM DIVERGENCE

[75] Inventor: James M. Bornhorst, Duncanville, Tex.

[73] Assignee: Vari-Lite, Inc., Dallas, Tex.

[21] Appl. No.: 706,720

[22] Filed: Feb. 28, 1985

[51] Int. Cl.[4] ..... F21V 9/00

[52] U.S. Cl. ..... 362/268; 362/285; 362/293; 362/324

[58] Field of Search ..... 362/231, 232, 238, 239, 362/285, 293, 305, 319, 270, 273, 281, 282, 283, 289, 268, 322, 324

[56] References Cited

U.S. PATENT DOCUMENTS

| | | | |
|---|---|---|---|
| 1,845,214 | 2/1932 | Arrousez | 362/289 |
| 2,009,145 | 7/1935 | Nathan . | |
| 2,192,520 | 3/1940 | Levy et al. . | |
| 2,214,728 | 9/1940 | Gille et al. . | |
| 2,625,851 | 1/1953 | Gelb . | |
| 2,659,038 | 11/1953 | Heyer . | |
| 2,660,926 | 12/1953 | Talley . | |
| 2,687,669 | 8/1954 | Bolsey . | |
| 2,841,065 | 7/1958 | Gage et al. . | |
| 2,950,382 | 8/1960 | Hatch . | |
| 2,951,430 | 9/1960 | Dumke et al. . | |
| 3,045,208 | 7/1962 | Tiberio . | |
| 3,085,468 | 4/1963 | Hehn . | |
| 3,184,307 | 5/1965 | Letzer . | |
| 3,515,800 | 6/1970 | Ebihara et al. . | |
| 3,529,889 | 9/1970 | De Mey II . | |
| 3,833,295 | 9/1974 | Bebb et al. . | |
| 3,845,351 | 10/1974 | Ballmoos et al. . | |
| 3,883,243 | 5/1975 | Weisglass et al. . | |
| 4,037,097 | 7/1977 | Stillman et al. . | |
| 4,043,646 | 8/1977 | Heine et al. . | |
| 4,392,187 | 7/1983 | Bornhorst | 362/233 |

*Primary Examiner*—Charles J. Myhre
*Assistant Examiner*—David A. Okonsky
*Attorney, Agent, or Firm*—Richards, Harris, Medlock & Andrews

[57] ABSTRACT

A variable light source includes a light (14) which projects a white light beam. Three filters sets (60, 62 and 64) each include three pivotable dichroic filter elements. Each element is rotatable around an axis perpendicular to the light beam in order to vary the angle of incidence to vary the hue of the light beam. Rotation of the filter elements also varies the white light transmitted past the filter elements in order to vary the saturation of the light. The distance between the light source (26) and the reflector (28) may be varied to change the divergence of the light beam.

47 Claims, 23 Drawing Figures

FIG. 2
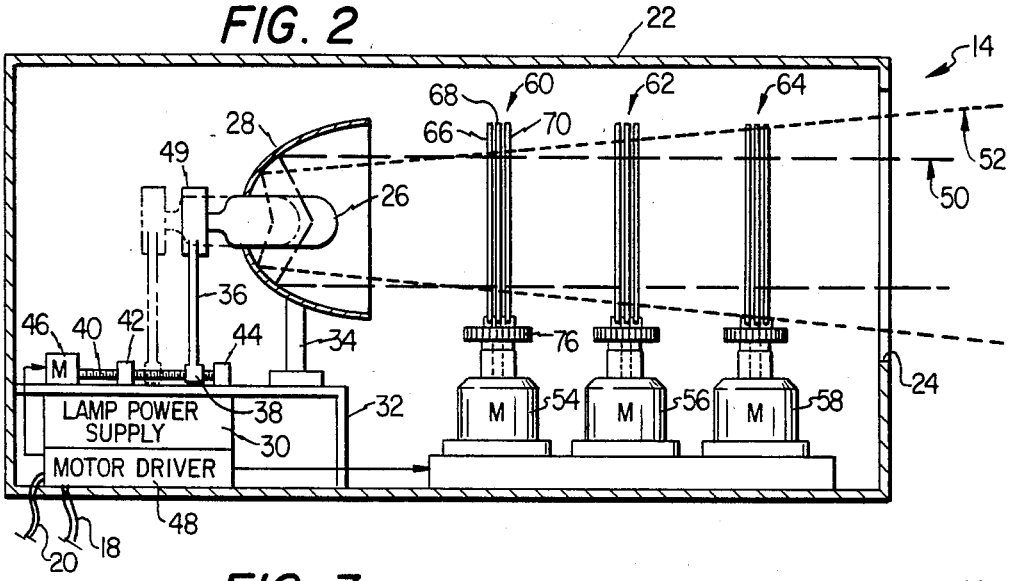
FIG. 3
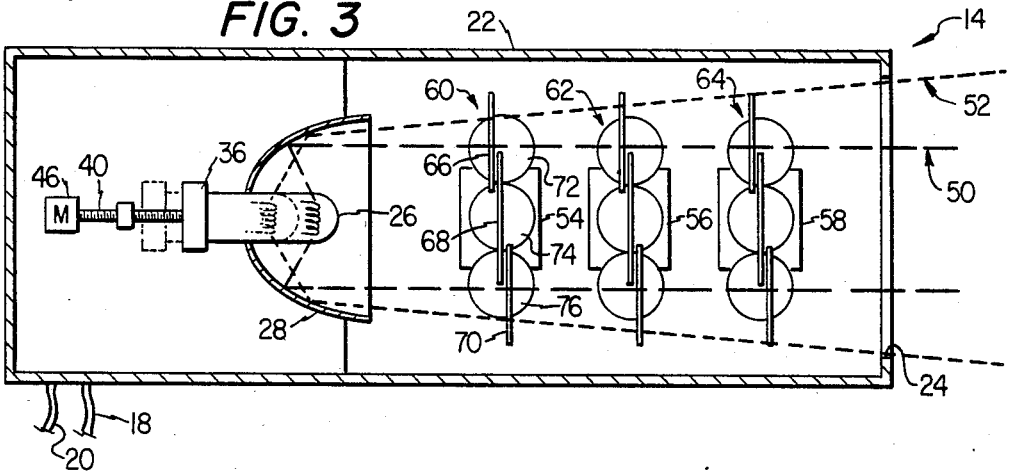
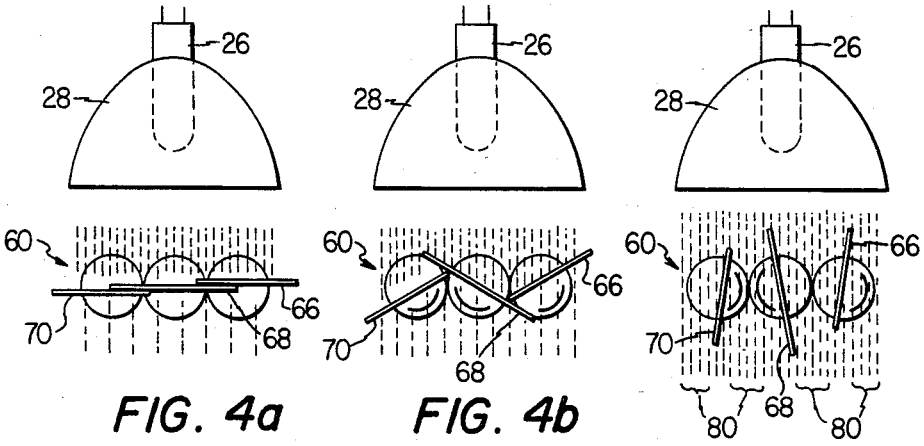
FIG. 4a FIG. 4b FIG. 4c

FIG. 9ℓ

LIGHT SOURCE HAVING AUTOMATICALLY VARIABLE HUE, SATURATION AND BEAM DIVERGENCE

TECHNICAL FIELD

This invention relates to illumination, and more particularly to a light source having variable parameters for use in the lighting of a stage, theater or any other environment.

BACKGROUND OF THE INVENTION

It has long been known to provide lighting to stages, theaters and other environments with the use of individual light sources hung from trusses or fixed structural members mounted adjacent to the area to be lit. Some light sources are used as wash or general stage illumination, while others of the light sources are used as spots for highlighting specific positions on stage, portions of an actor's body or the like. Other similar light sources are used in such environments as homes or offices.

Previous light sources have utilized colored celluloid gels which may be interposed in the light beam to change the lighting color. In addition, prior systems have used various techniques to vary the beam divergence and the intensity of the light beams.

Systems have also been heretofore developed for automatically varying the position, color, intensity and beam divergence of lighting sources used for the stage or theater. For example, U.S. Pat. No. 4,392,187, issued July 5, 1983 and entitled "Computer Controlled Lighting System Having Automatically Variable Position, Color, Intensity and Beam Divergence," by the present applicant, discloses a computerized lighting system where a plurality of light parameters may be automatically controlled. In U.S. Pat. No. 4,392,187, dichroic filters are movable within a light beam to vary the transmitted color from the light source. In this patent, one technique for utilizing dichroic filters causes aligned filters to be pivoted within the light beam to vary the angle of incidence of the light upon the filter. Integration lenses are required to mix white light with the colored light. Another technique disclosed in the patent utilizes rotatable disks having a plurality of dichroic filters which maya be variably indexed with one another in order to change the color of the light source.

While the system disclosed and claimed in U.S. Pat. No. 4,392,187 has been found to work well in actual practice, a need has arisen for a technique for using dichroic filters to vary the hue and saturation of a light beam which provides improved control, improved mechanical operation and reliability, and the capability of being very compactly packaged with a minimum of expensive components such as integration lenses and the like.

SUMMARY OF THE INVENTION

In accordance with the present invention, a light projects a light beam. At least two filter elements are disposed side by side across the light beam and are pivotal about spaced apart axes perpendicular to the light beam. Structure is provided to pivot the filter elements concomitantly with one another in order to vary the angle of incidence of the light beam upon both elements to vary the resulting color of the light beam.

In accordance with another aspect of the invention, a white light source includes three dichroic filter elements disposed side by side across the light beam and rotatable about spaced apart axes disposed perpendicular to the light beam. The dichroic filter elements are rotatable in synchronism in order to move from positions substantially parallel to the light beam to positions essentially perpendicular to the light beam in order to provide a wide variance of hue of the light source. Rotation of the filter elements also causes variance of the white light which passes by the filter elements in order to vary the saturation of the resulting light beam.

BRIEF DESCRIPTION OF THE DRAWINGS

A more complete understanding of the present invention may be had by reference to the following Detailed Description when taken in conjunction with the accompanying drawings, wherein:

FIG. 2 is a cross-section of one of the light sources in FIG. 1;

FIG. 3 is a top sectional view of the light source of FIG. 2;

FIGS. 4*a*–4*c* are somewhat diagrammatic illustrations of three positions of one set of the dichroic filter elements of the present invention which provide three distinct hues and saturation combinations;

FIGS. 9*a*–9*l* illustrate various positions of the filter sets of the invention in conjunction with graphs of the resulting transmittance versus wavelength.

DETAILED DESCRIPTION

Figure 1:
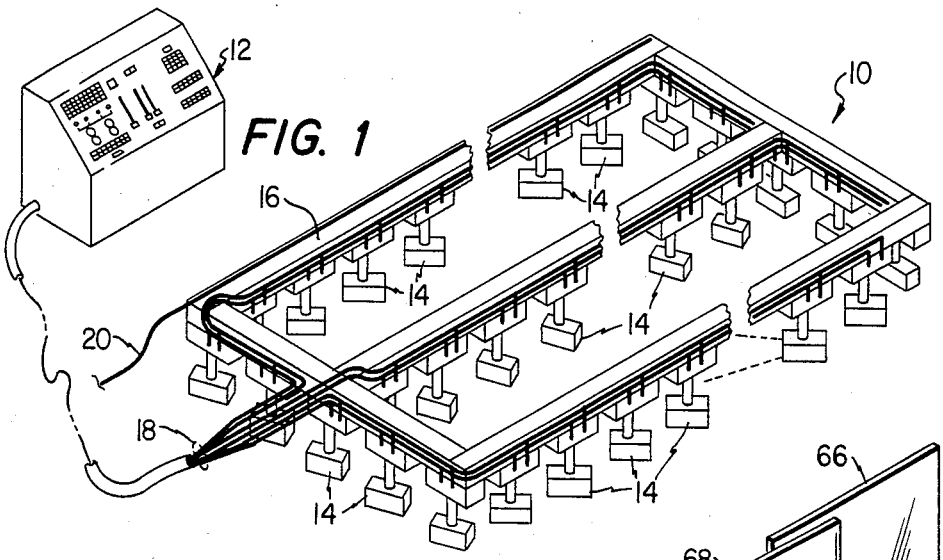
FIG. 1 is a perspective view of a lighting system including the light sources of the present invention.

Referring now to the drawings wherein like characters designate like or corresponding parts throughout several views, FIG. 1 illustrates a lighting system 10 forming an array of lighting sources of the present invention. Lighting system 10 may be used to light a theater, stage, home, office or other environment wherein variable hue and saturation of lighting is desired. System 10 is particularly useful for providing variable lighting for a musical concert or a theatrical performance.

Lighting system 10 includes a remote control panel 12 which may be located at some distance from the array and is operable to control the individual light sources 14 which are attached to trusses 16 fixed over or adjacent a stage. Remote control panel 12 includes a plurality of control buttons and switches which may be utilized to individually control various parameters such as positions, hues, saturations and beam divergences of each of the lighting sources 14. The control panel 12 generates system control signals which are applied via cable 18. Remote control panel 12 also includes a memory for recalling the position, hue, saturation and beam divergence of each light source 14 for each individual desired lighting change, commonly termed a cue. The remote control panel 12 may automatically set up an entire cue by the actuation of a single control on the control panel 12.

The functions provided by the system are accomplished with the use of the four conductor signal cable 18, along with a power cable 20. For more detail on the construction and operation of the control panel 12 and the remote control provided by the signal cable 18 to the individual light sources, reference is made to the previously described U.S. Pat. No. 4,392,187 and the disclosure thereof is incorporated herein by reference. The present light sources 14, as will be subsequently described, provide improved hue and saturation variance and are particularly adapted for accurate and reliable control by the signals provided on cable 18.

FIG. 2 illustrates a sectional side view of one of the light sources 14. A housing 22, which may be rectangular, circular or any shape in configuration, fully encloses a light source, except for a light aperture 24 which is formed in one end thereof. Aperture 24 is normally circular and may in some instances utilize a lens, a diffuser or glass cover, although such is not required. Housing 22 is normally connected to a gimbal which is controlled by one or more motors to control the position of the housing 22.

An electric lamp 26 generates a high intensity beam of white light which is reflected from a reflector 28 to form a light beam which passes through the aperture 24. Lamp 26 may comprise any suitable source of light, but a very high efficiency light source found useful with the present invention is a type 64663 HLX lamp made by Osram in Munich, West Germany. The reflector 28 may comprise, for example, reflector Part No. 02RPM001 sold by Melles Griot in Irving, Calif.

Electrical power for the lamp 26 is provided by a lamp power supply 30 which receives electricity from the power cable 20. The reflector 28 is fixed to an enclosure 32 by a fixed standard 34. Enclosure 32 encloses the lamp power supply 30. The lamp 26 is attached to a movable upright member 36 which is threadedly attached at its lowermost threaded end 38 to a lead screw drive 40. Lead screw drive 40 is rotatable through bearings 42 and 44. The end of the lead screw drive 40 is attached to a motor 46 which may be energized from a motor driver 48 located within the enclosure 32. Control signals for the operation of the motor driver 48 are supplied through the control cable 18.

Rotation of the motor 46 causes the lead screw drive 40 to rotate, thus causing the lowermost threaded end 38 to move along the length of the lead screw drive between the bearings 42 and 44. Movement of the upright member 36 thus causes movement of the lamp 26 relative to the reflector 28. FIG. 2 illustrates movement of the upright member 36 between the illustrated forwardmost position and a rearward position shown in dotted lines and identified by the numeral 49. Movement of the lamp relative to the reflector 28 causes a variance of the divergence of the light beam emitted from the light source 14. For example, in the forwardmost position of the lamp 26, a collimated spotlight 50 is provided. In the rearward position of the lamp 26, a diverging wash lamp beam 52 is provided. The control signals applied via cable 18 control the motor driver 48 in order to control operation of motor 46 to vary the divergence of the beam being transmitted from the light source 14.

The hue and saturation of the light beam emitted from the light source 14 may be controlled by selective rotation of motors 54, 56 and 58 which are spaced apart along a line parallel to the axis of the light beam from lamp 26. Electrical control signals applied via the electrical lead 18 are operable to selectively rotate any one or all three of the motors 54, 56 and 58. Associated with the motors 54, 56 and 58 are three sets of dichroic filters 60, 62 and 64.

FIG. 3 illustrates a top sectional view of the light source 14. FIG. 3 also shows the movement of the lamp 26 in order to vary the divergence of the light beam as previously noted. FIG. 3 further illustrates the three sets of dichroic filters 60, 62 and 64 as each including three dichroic filters. The filter sets 60–64 are similarly constructed and thus only filter set 60 will be described in detail.

Referring to FIG. 3, filter set 60 includes three dichroic filters 66, 68 and 70. Filter 66 is fixedly mounted upon a gear 72, filter 68 is fixedly mounted upon a gear 74 and filter 70 is fixedly mounted upon a gear 76. Gear 74 is directly coupled via gears to motor 54 and thus rotates upon energization of motor 54. Gear 74 is meshed with gears 72 and 76 such that rotation of gear 74 in one direction causes rotation of gears 72 and 76 in the opposite direction. Consequently, operation of motor 54 causes simultaneous or concomitant movement of all three gears 72, 74 and 76. This causes concurrent or concomitant pivoting motion of each of the filters 66, 68 and 70. Similarly, rotation of motor 56 causes simultaneous pivoting movement of the three dichroic filters making up filter set 62, and rotation of motor 58 causes simultaneous pivoting of the filters making up the filter set 64.

As discussed in previously noted U.S. Pat. No. 4,392,187, changing the angle of incidence of a dichroic filter relative to a light beam causes the color spectrum transmitted through the filter to be varied. Dichroic filters work on an interference principle, essentially separating two colors out of a white light source, one color being transmitted and the other color, the complement of that being transmitted, being reflected. Transmitted color through the dichroic filter depends upon the type of material used in the filter layers and its refractive index, the thickness of each layer, the number of the layers and the angle of the incidence of the white light source striking the surface of the filter. By thus varying the angle of incidence of the filters, a preselected range of colors may be produced. The present invention also controls the amount of white light passed between and around the filters which is mixed with the filtered color to vary the saturation of the transmitted hue.

The dichroic filters for use with the present invention may comprise numerous commercially available filters made from dielectric coatings on glass or the like. The dichroic film is made of multiple layers, alternate layers having low and high indexes of refraction, respectively. Each filter set includes a center filter element 68 which is slightly wider than the side filter elements 66 and 70. In one preferred embodiment of the invention, the two side filters 66 and 70 have dimensions of 1.5 inches in width and 3 inches in length, with the large central filter 68 having dimensions of 2 inches by 3 inches.

The filter elements in each filter set have identical optical characteristics, but each filter set has differing optical characteristics from the other two filter sets. For example, in a preferred embodiment of the invention, filter set 60 utilizes dichroic filters having characteristics providing a long wave pass or edge filter with a cutoff of approximately 635 nanometers, which thus operates as a red filter. Filter set 62 comprises dichroic filter elements having characteristics for providing a short wave pass or edge filter at 510 nanometers, to thus operate as a blue filter. Filter set 64 includes dichroic filters having characteristics for providing a notch filter with edges at 500 and 600 nanometers, and thus operates as a magenta filter. The order and characteristics of the filter sets may be varied, if desired. Commercially available dichroic filters for use with the present invention are manufactured and sold by Optical Coating Laboratory, Inc. of Santa Rosa, Calif.

FIGS. 4*a*–4*c* illustrate various positions of the filter set 60 in order to illustrate the variance of hue and saturation by the present invention. FIG. 4*a* illustrates an orientation wherein the filters 66, 68 and 70 are disposed normal to the light beam such that an angle of incidence of zero is provided between the light beam and the filters. In this position of the filters, the visible spectrum emanating from the lamp 26, which is commonly called white light, is limited by the filters to provide a narrow bandwidth, highly saturated deep red hue. High saturation is provided because no white light passes through or around the filters for mixing with the red light.

FIG. 4*b* illustrates rotation of the filters 66, 68 and 70 such that an angle of incidence of thirty (30) degrees is provided between each of the filters and the light emanated from lamp 26. In this configuration, a broader bandwidth, less saturated intermediate color such as orange or amber is transmitted from the light source.

In both FIGS. 4*a* and 4*b*, no white light is transmitted around the light source.

In FIG. 4*c*, the filters 66–70 have been rotated relative to the light beam to a position almost parallel to the light beam. In the illustrated position, an angle of incidence of eighty (80) degrees is provided between each of the filters to the light beam. In this configuration, a substantial amount of white light is transmitted around the filters. The white light transmitted is illustrated by areas generally designated by the numeral 80. This white light mixes with the colored light transmitted through the filters to provide a less saturated pastel color such as yellow. Because the white light is transmitted around and between the filters, integration lenses are not necessary to homogenize the light source, thus reducing cost, size and complexity.

Filter set 60 may be selectively pivoted to generate a highly saturated deep red hue or less saturated pastel yellow. Filter set 62 may be selectively pivoted to generate a highly saturated deep blue or less saturated pastel blue. Filter set 64 may be selectively pivoted to generate a highly saturated deep magenta or less saturated pastel pink. The filter sets 60–64 may be selectively varied in conjunction with one another to provide many combinations of hue and saturation. For example, filter sets 60 and 62 may be combined to generate various green hues.

It will thus be understood that the filters 66–70 may be rotated relative to the light beam to provide any desired angle of incidence in order to change the color hue, as well as the color saturation. If a white light source is required, the filters may all be rotated to a position directly parallel with the light rays so that no influence is provided by the filters on the output light beam. The permutations of color provided by the present invention are theoretically infinite, depending only upon the relative position of the filter sets. Each of the motors 54, 56 and 58 is independently operable in order to give a wide range of hue and saturation variations. Although three filter sets are illustrated, it will be understood that additional or fewer filter sets could be utilized, depending upon the desired light output of the device.

The use of dichroic filters is advantageous in that the filters transmit light incident thereon and reflect the complement of the color of the transmitted beam. Therefore, no light is absorbed and transferred or transformed to heat as found with previously used celluloid gels and the like. The lamp used with the present invention has relatively low power requirements and, therefore, substantially reduces the generation of infrared radiation. In addition, the particular construction of the present light source is inexpensive to construct, as it does not require collimating lenses or other complex optical mechanical structures. The present system may be very compactly packaged, but is very reliable and rugged with little required maintenance.

Although not illustrated, it will be understood that various other automatic features may be added to the present lamp, such as the use of a gimbal mechanism for providing various automatically controllable orientations to the lamp, as described more fully in the previously noted U.S. Pat. No. 4,392,187.

Figure 5A:
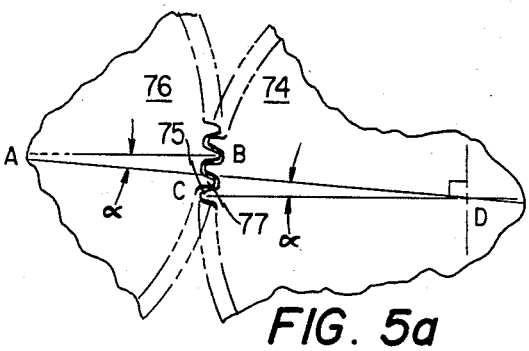
FIG. 5*a* illustrates an alternate configuration for the gears shown in FIG. 5.
Figure 5:
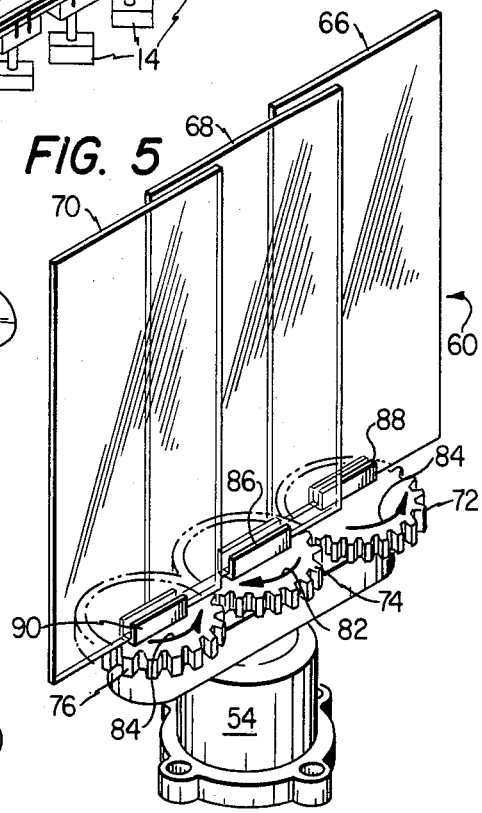
FIG. 5 is a perspective view of one set of the dichroic filter elements of the present invention.

FIG. 5 illustrates in greater detail the construction and operation of the filter set 60. It will be understood that filter sets 62 and 64 are identical or similar in construction and operation to filter set 60. As may seen, motor 54 is connected through a shaft and gear reduction in order to directly control the angle of operation of gear 74. Gear 74 meshes with both gears 72 and 76 to provide rotation thereof. In one embodiment of the invention, a gear train including three 64-pitch gears made by Secs, Inc. of Long Island City, N.Y. may be utilized. Motor 54 may comprise, for example, a stepper motor model No. P/N PA2201-P1 made and sold by the Airpacks Division of North American Phillips in Cheshire, Conn., and operating from a 5-volt electrical source. The stepper motor 54 may be very accurately controlled to position the gear 74 at the exact desired position.

Rotation of gear 74 in the clockwise position as illustrated by the arrow 82 causes gear 72 to rotate in the counterclockwise position as illustrated by arrow 84. Similarly, gear 76 is caused to rotate in the counterclockwise position as illustrated by the arrow 84. Located on gear 74 is a U-shaped mounting bracket 86. Filter 68 is fixedly mounted in bracket 86. Similarly, mounting bracket 88 is mounted on gear 72 and is fixedly attached to filter 66. Bracket 90 is mounted on gear 76 and is fixedly attached to filter 70. It will be noted from FIG. 5 that bracket 86 is centered in the middle of gear 74, while brackets 88 and 90 are slightly offset from the center of gears 72 and 76. The offsetting of the brackets allows the side by side relationship of the filters 66–70, wherein the edge portions of the filters overlap one another. The overlapping configuration allows positioning of the filters so no white light is transmitted, when desired. The filters and gears are constructed to provide concomitant movement of the filters, such that the angle of incidence of all three filters 66–70 is always the same. The overlapping of the edges of the filters does not appreciably change the filtering characteristics of the filter set because of the dichroic's low losses.

FIG. 5*a* illustrates an alternate configuration for gears 72–76. In this embodiment, the brackets 86–90 supporting filters 66–70 are not offset on gears 72–76, but the brackets 86–90 are centrally located on gears 72–76 in a similar manner as bracket 86 on gear 74. In order to allow filters 66–70 to overlap one another as shown in FIG. 5, the gears 72–76 are offset relative to one another.

The manner of offsetting gears 74 and 76 is illustrated in FIG. 5*a*. Lines AB and CD represent the filter center lines. The center line extends from the center of a gear tooth through the gear center to the center of the tooth directly opposite the starting tooth. This assumes the gear has an even number of teeth, which is preferred but not required. This explanation assumes an even number of teeth.

Gear 74 with its center at D has its filter line tooth 75 meshed one and one-half teeth or pitches below filter line tooth 77 of gear 76. The mesh could be $2\frac{1}{2}$ or $3\frac{1}{2}$, or any number of teeth plus $\frac{1}{2}$. This technique enables adjustment of the distance between the filter center lines for various glass thickness, different pitch and diameter gears.

The offset angle $\alpha$ is then $\frac{1}{2}$ the number of pitches between the filter line teeth, or in the general case:

$$\alpha^\circ = 360n/2T$$

Where:

$n = \frac{1}{2}, 1\frac{1}{2}, 2\frac{1}{2}, \ldots$ t=number of teeth on gear.

As may be determined from FIGS. 4*a* and 4*b*, the gears 72, 74, and 76, along with the width and placement of the filters 66, 68 and 70, allow the filters to be pivoted relative to one another without interfering with the motion of the adjacent filter. For example, FIG. 4*b* illustrates rotation of filter 68 in a clockwise position and rotation of filters 66 and 70 in a counterclockwise position to provide any desired angle of incidence, without interfering with the range of motion of the neighboring filters. This unique positioning and operation of the overlapped filters is an important aspect of the present invention in that it allows a wide variation of colors to be provided with very compact and inexpensive filter mechanisms.

Figure 6:
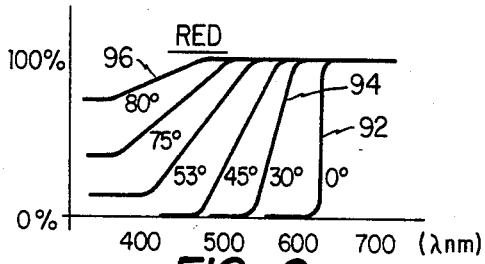
FIG. 6 is a graphical representation of the transmittance of the red filter set of the invention relative to transmitted wavelength of the light.

FIG. 6 is a graph illustrating the effect of the angle of incidence of the filter set 60 upon the transmitted color. Graph 92 depicts the transmittance versus wavelength when the angle of incidence of the dichroic red filter set 60 to the light beam is zero, as shown in FIG. 4*a*. Graph 94 illustrates the transmittance versus wavelength when the filters have an angle of incidence of thirty (30) degrees as shown in FIG. 4*b*. Graph 96 illustrates the transmittance versus color transmitted when the angle of incidence is eighty (80) degrees as shown in FIG. 4*c*. It will be noted that since no white light is transmitted in the positions shown in FIGS. 4*a* and 4*b*, the transmittance provided by such configurations is high in the red spectrum. Conversely, because of the amount of white light transmitted in the position shown in FIG. 4*c*, the filter provides a pastel yellow color.

Figure 7:
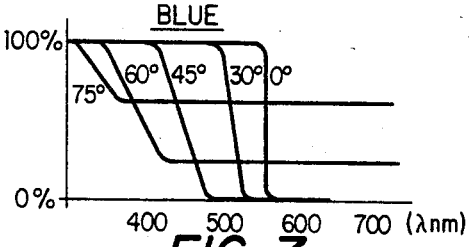
FIG. 7 is a graphical representation of the transmittance of the blue filter set as the angle of incidence is varied.

FIG. 7 is graph of transmittance versus wavelength for various angles of incidence of the blue filter set 62. It may be seen that as the angle of incidence of the light on the filter set changes from 0 to 75 degrees, the color transmitted by the filter set changes from a light blue green to a deep violet and as white light is added to a pastel lavender.

Figure 8:
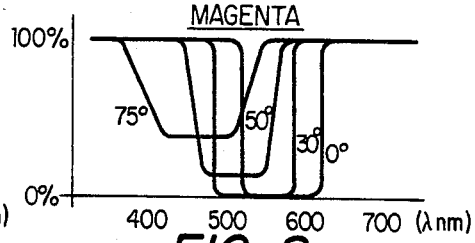
FIG. 8 is a graphical representation of the transmittance of the magenta filter set as the angle of incidence is varied.

FIG. 8 illustrates the transmittance versus wavelength of the magenta filter set 64 as the angle of incidence of the light varies on the filter set. As previously noted, the magenta filter set is a notch or double edge filter. Consequently, as the angle of evidence varies from zero degrees as illustrated in FIG. 8, the color changes from a deep magenta as the angle of incidence increases towards more pastel pinkish colors.

Figure 9A:
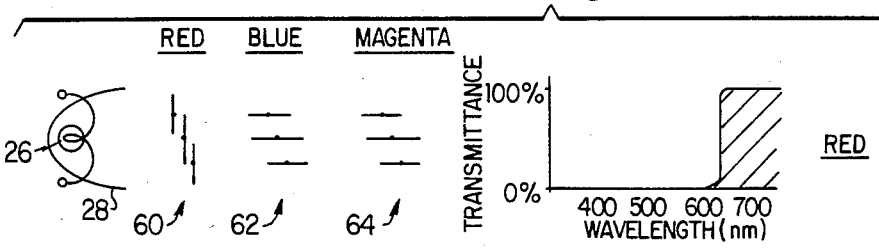

As previously noted, the present invention may be utilized to provide a wide variation of colors. FIGS. 9*a*–9*l* show some of the variations provided by the present invention. FIG. 9*a* illustrates the light 26 and the reflector 28 which projects a beam of light through the three filter sets 60, 62 and 64. FIG. 9*a* also illustrates a graph of the transmittance versus the wavelength of the resulting light passed through the filter sets. In FIG. 9*a*, the red filter set 60 is disposed essentially normally to the path of light, while the blue and magenta filter sets 62 and 64 are disposed parallel to the beam of light so as not to affect the beam of light. The resulting light is thus a deep saturated red color.

Figure 9B:
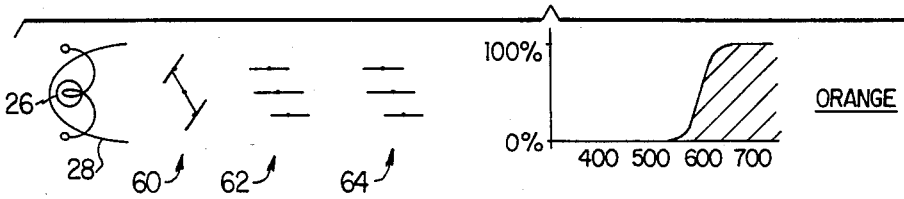

FIG. 9*b* illustrates pivoting of the red filter set 60 to increase the angle of incidence to provide a less saturated orange color.

Figure 9C:
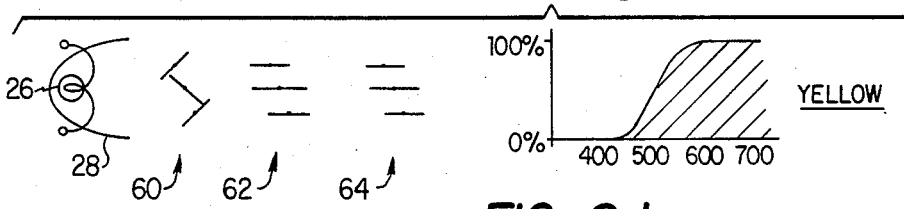

FIG. 9*c* illustrates further pivoting of the red filter set 60 while maintaining the blue and magenta filter sets parallel to the beam of light to provide a further unsaturated amber color.

Figure 9D:
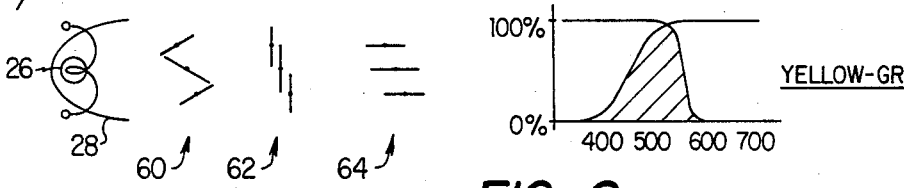

FIG. 9*d* illustrates further pivoting of the red filter set 60 and pivoting of the blue filter set 62 essentially normally to the beam of light. This causes the interaction of the filter effects for the two filter sets to provide the illustrated graphical representation of a yellow-green color.

Figure 9E:
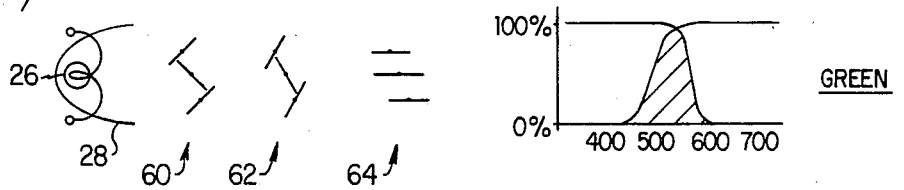

FIG. 9*e* illustrates further pivoting of the blue filter set 62 to the illustrated position to provide a more narrowly defined bandwidth for the light beam to generate a deep green color.

Figure 9F:
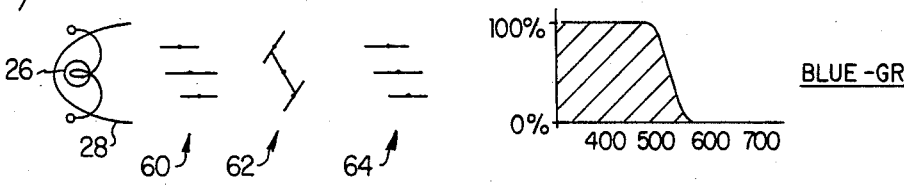

FIG. 9*f* illustrates pivoting of the red and magenta filter sets essentially parallel to the light beam while orienting the blue filter set 62 at the illustrated angles. This configuration reduces the illustrated bandwidth which provides a blue-green color.

Figure 9G:
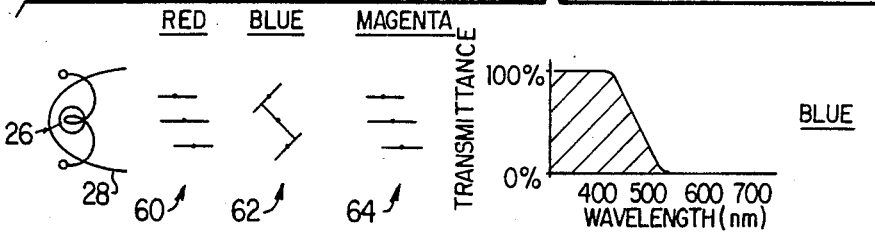

FIG. 9*g* illustrates further pivoting of the blue filter set 62 while maintaining the red and magenta filter sets parallel to the light beam. This produces a transmittance versus wavelength diagram as illustrated in FIG. 9*g* which generates a blue color.

Figure 9H:
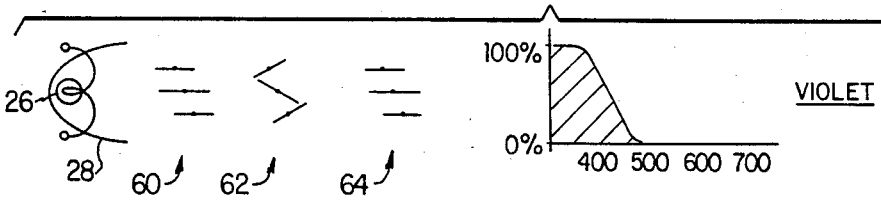

FIG. 9*h* illustrates further pivoting of the blue filter set to increase the saturation of the resulting light beam. This configuration produces a more saturated violet hue.

Figure 9I:
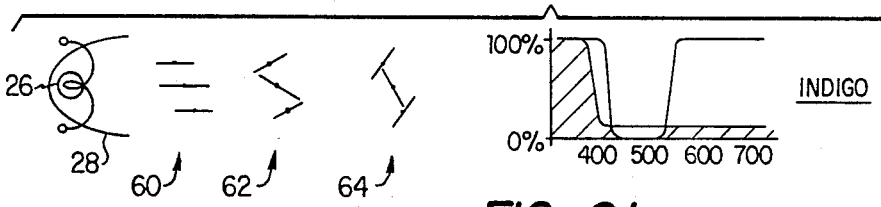

FIG. 9*i* illustrates further pivoting of the blue filter set 62 to allow white light to be transmitted both around the edges and between the filters of the blue filter set 62 and pivoting of the magenta filter set 64 as illustrated, with the red filter set 60 maintained essentially parallel to the light beam. This introduces the notch filter effect provided by the magenta filter to provide the illustrated transmittance versus wavelength graph shown in FIG. 9*i*. This orientation of the filters provides an indigo color.

Figure 9J:
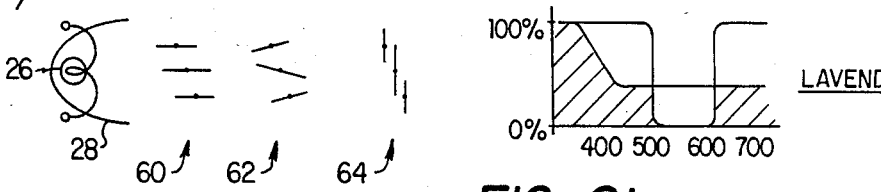

FIG. 9*j* illustrates further pivoting of the magenta filter 64 essentially normally to the light source to produce a saturated lavendar color.

Figure 9K:
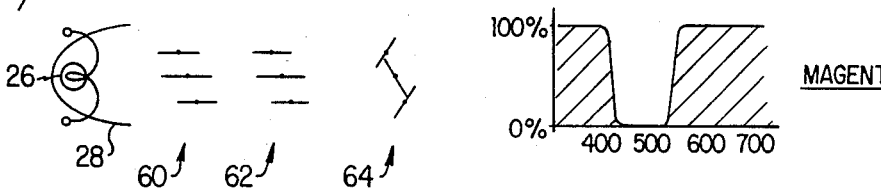
Figure 9K:
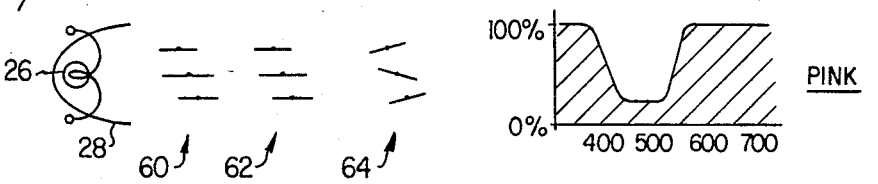

FIG. 9*k* illustrates maintaining the red and blue filter sets 60 and 62 essentially parallel to the light beam while pivoting the magenta filter set to the illustrated position.

This provides a lighter magenta color due to the notch filter effect.

FIG. 9*l* illustrates maintaining the red and blue filter sets 60 and 62 essentially parallel to the light beam, while only slightly pivoting the magenta filter set 64 relative to the light beam. This produces a less saturated pastel pink due to the addition of white light which passes around the edges of all filters.

It will be understood that a wide variety of different combinations of the filters may be provided to provide permutations of colors essentially across the entire visible light spectrum. The present system is thus able to vary both the hue and the saturation of the resulting light in a very accurate manner.

The present system may be thus understood to provide a light which may very accurately provide a wide range of desired hues, saturations and beam divergences. The present light source may be packaged in a relatively small and compact configuration and may be subjected to rough handling and still remain reliable. The present invention may be very accurately controlled with digital signals and is thus particularly useful with a system of the type disclosed in previously described U.S. Pat. No. 4,392,187. The present light source may however also be useful in other environments such as offices and homes.

Although several embodiments of the invention have been illustrated in the accompanying drawings and described in the foregoing Detailed Description, it will be understood that the present invention is not limited to the embodiments disclosed, but is capable of numerous rearrangements, modifications, substitution of parts and elements without departing from the spirit of the invention.

I claim:

1. A light assembly comprising:

means for projecting a light beam;

a filter set including at least two filters, said set having each filter mounted on a means for pivoting, each said means for pivoting being rotatable about respective axes which are disposed perpendicular to said light beam and are in a common plane which is generally transverse to said light beam; and said means for pivoting including means for concurrently pivoting said filters to selectively vary the angle of incidence of said light beam upon said filters to vary the resulting saturation and hue of said light beam.

2. The light assembly of claim 1 wherein said axes of said means for pivoting are spaced apart by a distance less than a width of one of said filters such that edges of said filters overlap when said filters are parallel.

3. The light assembly of claim 1 wherein said filters are spaced relative to one another such that the amount of light passing outside and between said filters is varied as said filters are pivoted, such that the saturation of the resulting light beam is varied.

4. The light assembly of claim 1 wherein said filter set comprises three rectangular filters.

5. The light assembly of claim 1 wherein said means for pivoting causes each said filter to rotate in an opposite angular direction from the adjacent ones of said filters.

6. The light assembly of claim 1 wherein said filters comprise dichroic filters.

7. The light assembly of claim 1 further comprising:

a second filter set similar to said first filter set and spaced apart from and parallel to said at least two filters.

8. The light assembly of claim 1 wherein said means for projecting a light source comprises a lamp and a reflector; and means for varying the relationship of said lamp to said reflector to vary the divergence of said light beam.

9. The light assembly of claim 1 wherein said means for concurrently pivoting said filters drives said filters between a first position having said filters transverse to said light beam for intercepting substantially all of said light beam and a second position having said filters parallel to said light beam for passing substantially all of said light beam outside and between said filters.

10. A light assembly comprising:

means for projecting a light beam; at least two filter elements, each filter element mounted on a means for pivoting, each said means for pivoting being rotatable, about spaced apart axes disposed perpendicular to said light beam, said filter elements concomitantly pivotal between first and second positions, said filter elements in said first position oriented in a side-by-side relationship such that said filter elements are generally perpendicular to said light beam, said filter elements in said second position being oriented generally parallel to the light beam;

a second set of three filter elements, said second set having each filter mounted on a means for pivoting, each said means for pivoting being rotatable about an axis disposed perpendicular to said light beam, said second set spaced apart from said at least two filter elements;

a third set of pivotal filter elements spaced apart from and parallel to said at least two filter elements; and means for pivoting said second set of filter elements to any position between said first and second positions in order to selectively vary the angle of incidence of said light beam upon said filter elements to vary the resulting saturation and hue of said light beam.

11. The light assembly of claim 10 wherein said means for projecting a light beam comprises a lamp and a reflector; and further comprising:

means for varying the relationship of said lamp to said reflector to vary the divergence of said light beam.

12. A light assembly comprising:

means for projecting a light beam;

a plurality of dichroic filters disposed transversely across a path of said light beam;

each of said filters being mounted on a means for pivoting, each said means for pivoting being rotatable about respective axes which are perpendicular to said light beam and are spaced transversely across the path of said light beam; and said means for pivoting including means for concomitantly rotating said filters about said axes such that the angles of incidence of said filters to said light beam are varied equally for each said filter, said filters being rotatable from positions which totally intercept said light beam to positions which permit portions of said light beam to pass unintercepted between said filters.

13. The light assembly of claim 12 and further comprising a second plurality of dichroic filters disposed transversely across the path of said light beam and spaced apart from said plurality of dichroic filters in said light beam; and means for concomitantly rotating said second plurality of dichroic filters to vary the angle of incidence of said second plurality of said filters to said light beam.

14. The light assembly of claim 12 wherein said means for projecting a light beam comprises a lamp and a reflector; and further comprising:

means for varying the relationship of said lamp to said reflector to vary the divergence of said light beam.

15. The light assembly of claim 12 wherein said one filter and said other filters are connected to gears which serially mesh with one another, rotation of one gear causing the other gears to concomitantly rotate.

16. The light assembly of claim 15 wherein said gears rotate in different directions to rotate said one filter and said other filters in different directions.

17. The light assembly of claim 15 wherein said other filters are mounted at offset locations on said gears.

18. The light assembly of claim 15 wherein said means for rotating rotates only one of said gears, such rotation causing rotation of the remaining gears in an opposite direction.

19. The light assembly of claim 15 wherein said gears are offset relative to one another.

20. The light assembly of claim 19 wherein said gears are offset from one another by an angle equal to 360n/2T, where $n=\frac{1}{2}, 1\frac{1}{2}, 2\frac{1}{2}, \ldots$ and T=number of teeth on each gear.

21. A light assembly comprising:

means for projecting a light beam;

a plurality of dichroic filters disposed across said light beam;

each of said filters being mounted on a means for pivoting, each said means for pivoting being rotatable about spaced apart axes perpendicular to said light beams;

said means for pivoting including means for concomitantly rotating said filters about said axes such that the angles of incidence of said filters to said light beam are varied equally for each said filter; and one of said filters is disposed centrally of said light beam and others of said filters are disposed on opposite sides of said one filter, edge portions of said one filter and said other filters overlapping one another when said one filter and said other filters are rotated to a position perpendicular to said light beam.

22. The light assembly of claim 21 wherein said means for projecting a light beam comprises a lamp and a reflector; and further comprising:

means for varying the relationship of said lamp to said reflector to vary the divergence of said light beam.

23. A light assembly comprising:

means for projecting a light beam;

a first plurality of dichroic filters disposed across said light beam;

said filters being mounted on a means for pivoting, each said means for pivoting being rotatable about spaced apart axes perpendicular to said light beam;

said means for pivoting including means for concomitantly rotating said first plurality of dichroic filters such that the angles of incidence of said filters to said light beam are varied equally for each said filter;

a second plurality of dichroic filters spaced apart from said first plurality of dichroic filters in said light beam;

means for concomitantly rotating said second plurality of dichroic filters to vary the angle of incidence of said filters to said light beam;

a third plurality of dichroic filters spaced apart from said second plurality of dichroic filters in said light beam; and means for concomitantly rotating said third plurality of dichroic filters to vary the angle of incidence of said filters to said light beam.

24. The light assembly of claim 23 wherein said means for projecting a light beam comprises a lamp and a reflector; and further comprising:

means for varying the relationship of said lamp to said reflector to vary the divergence of said light beam.

25. A light assembly having variable color comprising:

means for projecting a light beam;

a plurality of dichroic filters disposed side by side across said light beam;

means for pivoting each of said filters in order to vary the angle of incidence of said filters to said light beam; and edge portions of said filters overlapping one another when said filters are pivoted perpendicular to said light beam to form a continuous filter across said light beam.

26. The light assembly of claim 25 wherein each of said filters is pivoted by an equal amount such that the angle of incidence of each of said filters is equal to said light beam.

27. The light assembly of claim 25 wherein one of said filters is centrally disposed in said light beam and a filter is disposed on each side of said centrally disposed filter, said means for pivoting simultaneously pivoting each of said filters by equal amounts relative to said light beam.

28. The light assembly of claim 25 wherein said means for projecting a light beam comprises a lamp and a reflector; and further comprising:

means for varying the relationship of said lamp to said reflector to vary the divergence of said light beam.

29. The light assembly of claim 25 wherein said filters may be rotated to allow variable amounts of light to pass by said filters to vary the saturation of the resulting light beam.

30. The light assembly of claim 29 wherein said variable amounts of light are passed by said filters in a manner to eliminate the requirement of integration means.

31. The light assembly of claim 25 wherein said filters are connected to gears which mesh with one another, rotation of one gear causing the other gears to concomitantly rotate.

32. The light assembly of claim 31 wherein said gears rotate in different directions to rotate said filters in different directions.

33. The light assembly of claim 31 wherein ones of said filters are mounted at offset locations on said gears.

34. The light assembly of claim 31 wherein said gears are offset relative to one another.

35. The light assembly of claim 34 wherein said gears are offset from one another by an angle equal to 360n/2T, where $n=\frac{1}{2}, 1\frac{1}{2}, 2\frac{1}{2}, \ldots$ and T=number of teeth on each gear.

36. A method of varying the hue and saturation of a beam of light, comprising the steps of:

projecting a light beam;

disposing a plurality of dichroic filters across said light beam, said filters being mounted on a means for pivoting, each said means for pivoting being rotatable about spaced apart axes perpendicular to said light beam, said axes positioned in a plane essentially transverse to the path of said light beam; and concomitantly rotating said filters about said axes such that the angles of incidence of said filters to said light beam are varied equally for each said filter.

37. The light assembly of claim 36 and further comprising:

disposing a second plurality of dichroic filters spaced apart from said plurality of dichroic filters in said light beam; and concomitantly rotating said second plurality of dichroic filters to vary the angle of incidence of said second plurality of filters to said light beam.

38. The method of claim 36 wherein said filters can be set such that each said filter intercepts a different portion of said light beam and said filters can be set to pass unintercepted portions of said light beam outside and between said filters.

39. The method of claim 36 wherein the step of projecting a light beam comprises generating light from a lamp and directing said light by use of a reflector to form said light beam and further comprising the step of varying the relationship of said lamp to said reflector to vary the divergence of said light beam.

40. A method of varying the hue and saturation of a beam of light comprising:

projecting a light beam;

disposing a plurality of dichroic filters side by side across said light beam, said filters being mounted on a means for pivoting, each said means for pivoting being rotatable about spaced apart axes perpendicular to said light beam;

concomitantly rotating said filters about said axes such that the angles of incidence of said filters to said light beam are varied equally for each said filters, and disposing one of said filters centrally in said light beam and others of said filters on opposite sides of said one filter, the edge portions of said filters overlapping one another when said filters are rotated to a position perpendicular to said light beam.

41. The method of varying the hue and saturation of a beam of light as recited in claim 40 further comprising:

connecting said filters to gears which mesh with one another, rotation of one gear causing the other gears to concomitantly rotate.

42. The method of varying the hue and saturation of a beam of light as recited in claim 40 wherein rotation of said one gear causes rotation of the remaining gears in an opposite direction.

43. The method of claim 40 wherein the step of projecting a light beam comprises generating light from a lamp and directing the light into a beam by use of a reflector and further comprising the step of:

varying the relationship of said lamp to said reflector to vary the divergence of said light beam.

44. The method of varying the hue and saturation of a beam of light, comprising the steps of:

projecting a white light beam;

varying the angle of incidence of a plurality of filters in said light beam, said filters being mounted on a means for pivoting, each said means for pivoting being rotatably positioned along a line generally transverse to said light beam, in order to vary the hue of the resulting light beam; and varying the amount of white light passed between said filters and outside said filters in order to vary the saturation of the resulting light beam while maintaining the homogenization of the resulting light beam.

45. The method of claim 44 wherein the step of projecting a white light beam comprises generating light by use of a lamp and projecting said beam from a reflector and further comprising the step of:

varying the relationship of said lamp to said reflector to vary the divergence of said light beam.

46. A light assembly comprising:

means for projecting a light beam;

at least two filter elements, each filter element mounted on a means for pivoting, each said means for pivoting being rotatable, about spaced apart axes disposed perpendicular to said light beam, said filter elements concomitantly pivotal between first and second positions, said filter elements in said first position oriented in a side-by-side relationship such that said filter elements are generally perpendicular to said light beam, said filter elements in said second position being oriented generally parallel to the light beam;

a second set of at least two filter elements, said second set having each filter mounted on a means for pivoting, each said means for pivoting being rotatable about an axis disposed perpendicular to said light beam, said second set spaced apart from said at least two filter elements;

a third set of pivotal filter elements spaced apart from and parallel to said at least two filter elements; and means for pivoting said second set of filter elements to any position between said first and second positions in order to selectively vary the angle of incidence of said light beam upon said filter elements to vary the resulting saturation and hue of said light beam.

47. A light assembly, comprising:

means for projecting a light beam along an axis;

a filter set including at least two filters, said filters lying within respective planes and positioned in said light beam to intercept a different portion of said light beam; wherein the portion of said light beam which passes through one of said filters does not pass through the others of said filters; and means for pivoting said filters to selectively vary an inclusive angle between each said respective plane and said light beam axis to change the resulting saturation and hue of said light beam.

* * * * *